United States Patent [19]

Reuland

[11] 4,424,443

[45] Jan. 3, 1984

[54] APPARATUS FOR MEASURING THE DENSITY OF CIGARETTE RODS OR THE LIKE

[75] Inventor: Joachim Reuland, Neu Börnsen, Fed. Rep. of Germany

[73] Assignee: Hauni-Werke Körber & Co. KG., Hamburg, Fed. Rep. of Germany

[21] Appl. No.: 192,905

[22] Filed: Oct. 1, 1980

[30] Foreign Application Priority Data

Oct. 13, 1979 [DE] Fed. Rep. of Germany ..... 2941580

[51] Int. Cl.[3] ..... G01D 18/00; G01N 23/00

[52] U.S. Cl. ..... 250/252.1; 250/308; 250/359.1

[58] Field of Search ..... 250/252, 358 R, 359, 250/360, 308; 131/905; 324/58.5 A

[56] References Cited

U.S. PATENT DOCUMENTS

| | | | |
|---|---|---|---|
| 2,532,817 | 12/1950 | Lafferty et al. | 324/58.5 A |
| 2,938,520 | 5/1960 | Powell | 250/308 |
| 3,056,026 | 9/1962 | Bigelow | 250/359 |
| 3,529,153 | 9/1970 | Zimmerman et al. | 250/252 |
| 3,683,187 | 8/1972 | Tompkins | 250/252 |
| 4,024,394 | 5/1977 | Reuland | 250/359 |

*Primary Examiner*—Janice A. Howell
*Attorney, Agent, or Firm*—Kontler, Grimes & Battersby

[57] ABSTRACT

Apparatus for measuring the density of a cigarette rod which is moved lengthwise has a source of penetrative radiation at one side and a single ionization chamber at the other side of the path of the rod. A reciprocable slide or diaphragm causes the radiation to alternately penetrate through the rod and thereupon into the chamber in a first position and to bypass the rod in a second position of the slide or diaphragm. The ionization chamber converts radiation which has penetrated through the rod into first electric signals and the radiation which has bypassed the rod into second electric signals. An evaluating circuit stores each second signal during the next-following interval of generation of first signals, and the evaluating circuit compares the first signals with that second signal which is then stored in the evaluating circuit. Signals denoting the difference between the first signals and the stored second signal can be displayed and/or used to adjust the machine which produces the rod if the difference between the first signals and the stored second signal is indicative of unsatisfactory density.

13 Claims, 2 Drawing Figures

APPARATUS FOR MEASURING THE DENSITY OF CIGARETTE RODS OR THE LIKE

BACKGROUND OF THE INVENTION

The present invention relates to improvements in apparatus for measuring or gaging the density of a continuous or discontinuous rod-like body, especially for continuously measuring the density of an elongated rod-shaped body which constitutes or forms part of or is divisible into smokers' products and wherein a rod-like filler or natural, reconstituted or substitute tobacco or other fibrous material is surrounded by one or more tubular wrappers consisting of cigarette paper, artificial cork, reconstituted tobacco sheet stock or other suitable sheet-like or web-like wrapping material. More particularly, the invention relates to improvements in apparatus for measuring or gaging the density of tobacco rods or the like by ascertaining the percentage of those rays or beams of a penetrative radiation which are absorbed by the rod.

It is already known to ascertain the density of a moving tobacco rod (e.g., a continuous cigarette rod which is manufactured in a cigarette maker and is severed at regular intervals to yield plain cigarettes of unit length or multiple unit length) by utilizing a source of penetrative radiation which passes through and is partially absorbed by successive portions or increments of the rod, by generating a reference beam of radiation which bypasses the path for the rod, and by further employing a stationary transducer which generates first electric signals whose intensity or another characteristic is proportional to the radiation (sample beam) that has passed through the rod and second electric signals whose intensity is indicative of the intensity of radiation (reference beam) which has bypassed the rod. Thus, whereas the radiation (sample beam) which is converted into first electric signals transverses the path for the rod, the radiation (reference beam) which is used for the generation of second electric signals is prevented from passing through and being weakened (partially absorbed) by the rod. The first and second electric signals are transmitted to an evaluating circuit which compares the first and second signals and can generate third signals denoting the deviation of actual (measured) density from the desired or optimum density.

Uniform density of a tobacco rod is a characteristic which is highly desirable and is invariably expected from the manufacturers of cigarettes or analogous smokers' products including cigars, cigarettes, cigarillos and/or others. Therefore, a cigarette maker or an analogous machine for the manufacture of rod-shaped smokers' products is invariably equipped with an apparatus which continuously gages the density of the moving tobacco-containing rod and informs the attendants when the density is unsatisfactory or automatically effects and appropriate adjustment to alter the density so that the deviation from a desired or optimum value is maintained within acceptable limits or is reduced to zero.

Many presently known apparatus which are used to measure the density of a continuous tobacco-containing or like rod (hereinafter called cigarette rod for short with the understanding, however, that the invention can be practiced with equal advantage to gage the density of rods which contain fibrous filter material as well as tobacco or a mixture of tobacco with other materials of the type used in the manufacture of cigars, cigarillos or analogous rod-shaped articles which constitute or form part of smokers' products) employ radioactive sources and a transducer in the form of an ionization chamber. Such apparatus enjoy widespread use in many types of machines for the production of cigarettes or the like. A comparison of the first electric signals which are obtained by conversion of radiation (sample beam) that has passed through successive increments of a moving cigarette rod with second electric signals which are obtained as a result of conversion of a reference beam which was caused to bypass the cigarette rod enables the evaluating circuit to readily ascertain whether or not the density of the rod is acceptable. Absorption by the cigarette rod of radiation which is used for the generation of first signals is proportional to density of the corresponding increments or unit lengths of the rod. The (third) signals which denote the difference between the first and second signals can be displayed to inform the attendants of the actual density of the rod or such third signals can be used to regulate the means which controls the density of the rod in a cigarette maker or the like.

Commonly owned German Auslegeschrift No. 1,241,740 discloses an apparatus for continuous measurement of the density of a running continuous cigarette rod. The apparatus employs two discrete sources of radioactive radiation. The arrangement is such that radiation issuing from both sources simultaneously penetrates through and is thereby absorbed, in part, by successive increments of the moving rod. The two partially absorbed beams of radiation are caused to impinge upon an ionization chamber which generates electric signals of corresponding intensity. The use of two discrete radiation sources, which are disposed at a predetermined angular distance from each other, is recommended by the applicants named in the aforsaid German Auslegeschrift in order to ensure that the two beams intersect each other in the interior of the moving rod; this, in turn, is to guarantee that the measurement invariably embraces the entire cross-sectional area of the moving rod.

The apparatus which is disclosed in the German Auslegeschrift exhibits certain drawbacks. Thus, ionization chambers are affected by changes in temperature, i.e., the results of measurements with an apparatus which utilizes a transducer in the form of an ionization chamber are normally influenced (distorted) in response to changes of temperature of the ionization chamber. Therefore, the ionization chamber must be calibrated and tested at frequent intervals in order to ascertain the extent of deviation (if any) from normal operating conditions. As a rule, the calibrating operation takes place while the machine which embodies the apparatus is at a standstill, i.e., prior to transport of a cigarette rod across the beams of radioactive radiation. If the drift of the operating point of the ionization chamber takes place while the apparatus is in actual use, the results of density measurements will be misleading and automatic adjustments of the rod forming mechanism in response to the results of such misleading or inaccurate measurements will cause the density of the rod to deviate even further from the desired or optimum density. Moreover, calibration of the ionization chamber in the just discussed conventional apparatus is a complex and time-consuming procedure. Still further, the utilization of several radiation sources is not always desirable because it contributes to the initial and maintenance cost of the apparatus.

U.S. Pat. No. 3,056,026 granted Sept. 25, 1962 to Bigelow discloses a modified density measuring or gaging apparatus wherein the radiation source emits X-rays. The transducer is a twin ionization chamber which comprises two primary plate-like electrodes as well as a third or measuring electrode between the primary electrodes. The measuring electrode divides the ionization chamber into two discrete sections or compartments. A portion of radiation which issuses from the source (such as a conventional X-ray tube) penetrates through the moving cigarette rod and thereupon enters one section of the ionization chamber, i.e., that section or compartment which is located between one of the primary electrodes and the measuring electrode. The remaining portion of radiation which issues from the source of X-rays penetrates through a calibrating object and thereupon reaches the other section of the ionization chamber, i.e., the compartment between the measuring electrode and the other primary electrode. When the intensity of radiation which has penetrated through the rod deviates from the intensity of the other portion of radiation (which has penetrated through the calibrating object), the measuring electrode furnishes a difference signal which is evaluated and can be used to regulate the density of the rod by appropriate automatic adjustment of the rod forming mechanism.

The apparatus of the just discussed U.S. Pat. No. 3,056,026 also exhibits several drawbacks. Thus, the results of the density measurements are reliable only and alone if the radiation source invariably furnishes radiation of predetermined intensity, if the position of the radiation source with reference to the ionization chamber is selected with utmost accuracy, and if the temperature of the ionization chamber is maintained within a narrow range. Otherwise, the apparatus is likely to furnish highly distorted density measurements with the result that the cigarettes are too light (which can amount to pronounced deviations from standards that are prescribed by the authorities) or too heavy (with attendant losses of tobacco to the manufacturer). Still further, the use of a twin or dual ionization chamber is not an optimum solution because drift phenomena, if any, of the operating point are not likely to be equally pronounced in each section or compartment of such ionization chamber. If the drift phenomena are not identical, electric signals which are generated by the ionization chamber are not reflective of true or actual density of the monitored cigarette rod.

U.S. Pat. No. 2,938,520 granted May 31, 1960 to Powell discloses a further density measuring apparatus comprising two measuring units each of which is associated with a discrete ionization chamber. One of the measuring units monitors the moving cigarette rod and the other measuring unit cooperates with the respective ionization chamber and with a reference object to generate a reference signal. The reference signal is compared with the sample signal which denotes the rate of absorption of radiation that has passed through successive increments of the cigarette rod, and the results of such comparison can be used to effect an adjustment of the mechanism which is responsible for (i.e., which can change) the density of the rod. A drawback of the apparatus which is disclosed in U.S. Pat. No. 2,938,520 is that not only its initial but also its maintenance cost is extremely high. Moreover, and since the drift phenomena of operating points of the two ionization chambers are unlikely to be of identical magnitude, density signals which are generated by an evaluating circuit serving to receive electric signals from the outputs of the two discrete ionization chambers are misleading or are likely to be misleading, i.e., their deviation from signals denoting the actual density can be sufficiently pronounced to entail segregation of satisfactory cigarettes, to entail retention of unsatisfactory cigarettes and to reduce the likelihood of timely adjustment of the density influencing mechanism in a cigarette maker or the like.

OBJECTS AND SUMMARY OF THE INVENTION

An object of the invention is to provide an apparatus which can be used for continuous measurement or gaging of the density of a running cigarette rod or the like and which, though not more complex or bulkier than theretofore known apparatus, is more reliable and more compact than such conventional apparatus.

Another object of the invention is to provide a density measuring apparatus which can be installed in existing cigarette makers or analogous machines as a superior substitute for conventional density measuring apparatus.

A further object of the invention is to provide a density measuring apparatus wherein drift phenomena and like unpredictable factors cannot adversely influence the accuracy of the measurements.

An additional object of the invention is to provide an apparatus of the above outlined character wherein the transducer can and normally does comprise a single ionization chamber and wherein drift phenomena of the operating point of the ionization chamber are incapable of distorting the results of density measurements by the circuitry which receives electric signals from the output of the ionization chamber.

A further object of the invention is to provide a self-regulating apparatus which can automatically calibrate its evaluating system to ensure that the influence of drift of the operating point of the transducer which converts radiation signals into electric signals cannot distort the results of density measurements.

Another object of the invention is to provide a very simple and compact apparatus which comprises a surprisingly small number of relatively simple parts, which can stand long periods of continuous use, and which can be readily adjusted to guarantee highly reliable measurements of the density of successive increments of a moving cigarette rod or the like.

Still another object of the invention is to provide a density measuring apparatus which can be tested and calibrated while the machine which produces and/or processes a continuous cigarette rod or the like is in actual use.

A further object of the invention is to provide a density measuring apparatus wherein the calibration of the evaluating system takes up very short intervals of time and wherein such calibration does not necessitate even short-lasting interruption of lengthwise transport of a continuous or discontinuous rod containing a filler of tobacco or other fibrous material.

The invention is embodied in an apparatus for measuring the density of a rod (e.g., a continuous cigarette rod) which contains tobacco and/or other fibrous material and is transported (normally lengthwise) along a predetermined path (for example, from the wrapping mechanism to the cutoff in a cigarette maker, such as the machine which is known as SE and is manufactured by the assignee of the present application), a source of penetrative radiation (such source may consist of a single radiation emitting component or it may comprise several discrete radiation emitting components, e.g., emitters or beta rays), selector means which is operative to cause radiation issuing from the source to propagate itself (a) across the path for the rod whereby the intensity of radiation decreases during penetration through the rod in the path proportionally with the density of the corresponding portion or increment of the moving rod and (b) past the path for the rod so that the intensity of radiation which bypasses the rod remains at least substantially unchanged, common transducer means (e.g., a single ionization chamber) for converting the radiation (sample beam) which has penetrated through the rod in the predetermined path into first electric signals and for converting radiation which has bypassed the path into second electric signals, and signal evaluating means connected with the transducer means and including means for storing each freshly generated second signal during the next-following period of generation of first signals owing to penetration of radiation through the rod in the path and means for comparing each stored second signal with those first signals which are generated by the transducer means during storage of a second signal.

The selector means may comprise a device (e.g., a reciprocable slide which carries a radiation source consisting of a single radiation emitting component, or a reciprocable diaphragm which is movable along a source consisting of two discrete stationary radiation emitting components) movable between a first position in which the device prevents radiation from bypassing the rod and a second position in which the device prevents radiation from penetrating through the rod. The selector means then further comprises means (e.g., an electromagnet which can be energized or deenergized by a time-dependent actuating element) for alternately and automatically maintaining the aforementioned device in the first and second positions for first and second intervals of time. The second intervals can be shorter than the first intervals (for example, the duration of each first interval can be in the range of approximately 100 seconds).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
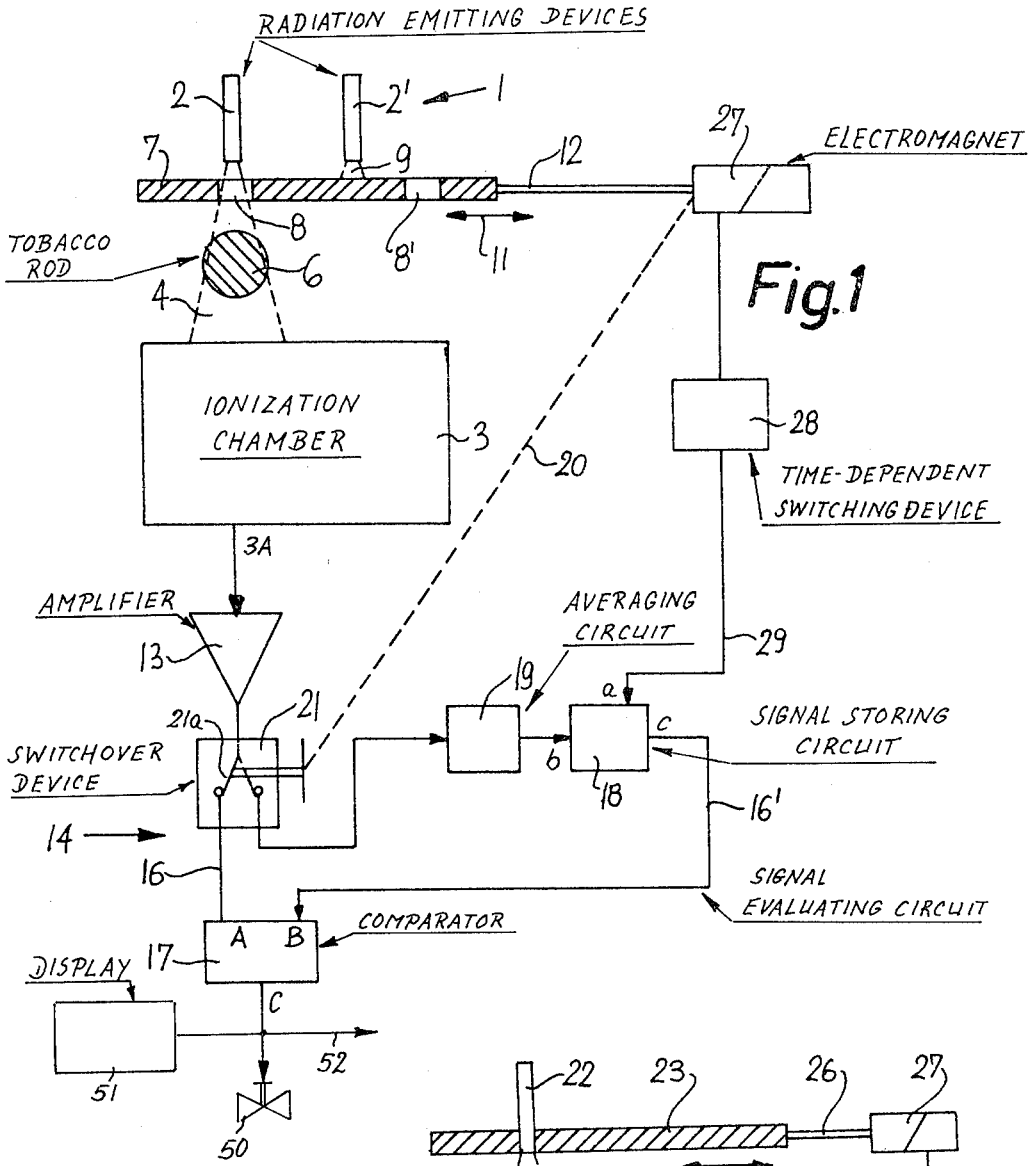
FIG. 1 is a diagrammatic view of a first embodiment of the improved apparatus, a portion of the selector means and the tobacco-containing rod being shown in section.

The density measuring or gaging apparatus which is shown in FIG. 1 comprises a source 1 of penetrative radiation. This source comprises two discrete radiation emitting components 2 and 2′ which emit radiation toward a common transducer 3, namely, an ionization chamber serving to convert radiation signals into corresponding electric signals. Radiation (namely, a sample beam shown at 4) which issues from the component 2 of the radiation source 1 passes through a continuous or discontinuous rod 6, e.g., a cigarette rod having a tubular wrapper of cigarette paper or like wrapping material and a rod-like filler of natural, synthetic or substitute tobacco. The path of the rod 6 extends at right angles to the plane of FIG. 1. The apparatus can be installed in a cigarette maker between the wrapping mechanism which applies the aforementioned tubular wrapper around the rod-like filler of fibrous material and a conventional cutoff which severs the wrapped rod at regular intervals so that the rod yields a file of discrete plain cigarettes of unit length or multiple unit length.

The path of the rod 6 extends between the ionization chamber 3 and the components 2 and 2′ of the radiation source 1. The components 2 and 2′ are fixedly mounted in the frame (not shown) of the cigarette maker.

The measuring apparatus of FIG. 1 further comprises a selector unit which determines whether the ionization chamber 3 generates electric signals whose intensity or another characteristic is proportional to that of the radiation (sample beam) 4 issuing from the component 2 and passing through the moving rod 6, or electric signals whose intensity or another characteristic is indicative of the intensity of radiation (reference beam) 9 issuing from the component 2′. It will be noted that the radiation 9 bypasses the path for the rod 6. The selector unit comprises a plate-like diaphragm 7 which is reciprocable in a plane between the radiation-emitting ends of the components 2, 2′ and the path for the rod 6. This diaphragm has two spaced-apart apertures 8 and 8′. In the position of FIG. 1, the diaphragm 7 maintains the aperture 8 in register with the sample beam 4 so that the ionization chamber 3 is exposed to radiation which has been caused to penetrate through the rod 6. The intensity of the (first) electric signals generated by the ionization chamber 3 and appearing at its output 3A is indicative of the density of corresponding portions or increments of the moving rod 6. When the diaphragm 7 is shifted from the first position which is shown in FIG. 1 to a second position in which the opening 8′ registers with the reference beam 9 issuing from the component 2′ of the radiation source 1, the diaphragm intercepts the sample beam 4 which issues from the component 2, and the output 3A of the ionization chamber 3 then transmits a second or reference signal whose intensity or another characteristic is not affected by the rod 6. In other words, the opening 8 is out of register with the reference beam 4 when the diaphragm 7 is shifted to its second position. The directions in which the diaphragm 7 is movable between the first and second positions are indicated by the double-headed arrow 11.

The selector unit of the apparatus which is shown in FIG. 1 further comprises means for alternately maintaining the diaphragm 7 in the first and second positions. Such means for maintaining comprises a drive here shown as including an electromagnet 27 and an operative connection 12 between the electromagnet and the diaphragm 7. The operative connection 12 may constitute a reciprocable armature of the electromagnet 27. The latter is energizable at preselected (and preferably variable) intervals by a time-dependent switching or energizing device 28 of any known design so that the diaphragm 7 is maintained in the first position for a predetermined first interval of time (e.g., 100 seconds), thereupon in the second position for a predetermined second interval of time (which can be a very small fraction of the first interval), thereupon again in the first position for the first interval of time, and so forth.

It is clear that the illustrated drive including the electromagnet 27 with a reciprocable connecting means or armature 12 can be replaced with other drive means, e.g., with a double-acting pneumatic or hydraulic cylinder and piston motor, with a rotary electromagnet, with a rack and pinion drive and/or others.

The apparatus of FIG. 1 further comprises an evaluating circuit 14 which receives electric signals from the output 3A of the ionization chamber 3 by way of an amplifier 13 and a two-position switchover device 21 which is mechanically or otherwise coupled to the electromagnet 27. The evaluating circuit 14 includes two branches 16 and 16'. The branch 16 receives electric signals from the amplifier 13 when the movable contact 21*a* of the switchover device 21 assumes the illustrated position, and such signals are transmitted to the input A of a comparator 17 (e.g., a conventional signal comparing stage) which has a second input B and an output C. The output C is connected with an ejector 50 which can be used in the cigarette maker to segregate defective or potentially defective cigarettes from satisfactory cigarettes.

The other branch 16' of the evaluating circuit 14 contains a signal storing circuit 18 having inputs a and b. The input b is connected with the output of the amplifier 13 when the movable contact 21*a* of the switchover device 21 assumes the other end position which is indicated by broken lines. The input b of the signal storing circuit 18 then receives a (second or reference) signal via averaging circuit 19. The input a of the signal storing circuit 18 is connected with the time-dependent switching device 28 by conductor means 29, and the output c of the circuit 18 is connected with the input B of the comparator 17. The purpose of the averaging circuit 19 is to average the noise of the ionization chamber 3. The operative (e.g., mechanical) connection 20 between the switch 21 and the electromagnet 27 ensures that the position of the movable contact 21*a* changes simultaneously or substantially simultaneously with movement of the diaphragm 7 to the first or second position. The arrangement is such that the movable contact 21*a* is held in the solid-line position of FIG. 1 when the diaphragm 7 prevents the reference beam 9 issuing from the component 2' from reaching the ionization chamber 3, i.e., when the output 3A of this chamber transmits electric signals denoting the density of corresponding portions of the moving rod 6. The ionization chamber 3 is exposed to radiation represented by the reference beam 9 when the diaphragm 7 assumes the other position and the movable contact 21*a* then assumes the broken-line position of FIG. 1 so that the signal storing circuit 18 receives a second electric signal (reference signal) via averaging circuit 19 and stores such second signal for the next-following first interval of time, i.e., while the input A of the comparator 17 receives first signals from the amplifier 13 via movable contact 21*a* of the switchover device 21.

The operation of the density measuring apparatus which is shown in FIG. 1 is as follows:

The diaphragm 7 is maintained in the first position so that the apertures 8 and 8' respectively register with and are out of register with the beams 4 and 9. The sample beam 4 from the component 2 of the radiation source 1 penetrates through and is partially absorbed by the material of the moving rod 6 so that the electric signals at the output 3A of the ionization chamber 3 are indicative of the density of successive increments of the moving rod 6. The diaphragm 7 intercepts the reference beam 9 which issues from the component 2' of the radiation source 1. The first electric signals which are transmitted by the output 3A of the ionization chamber 3 are amplified by the amplifier 13 and are then transmitted to the input A of the comparator 17 via movable contact 21*a* of the switchover device 21 and the branch 16 of the evaluating circuit 14. At the same time, the input B of the comparator 17 receives a second electric signal (reference signal) which is stored in the signal storing circuit 18. Such signal is transmitted via branch 16' of the evaluating circuit 14. The comparator 17 compares the two signals and its output C transmits third signals whose intensity or another characteristic is indicative of the difference between the first signals applied to the input A and the second or reference signal applied to the input B. If the difference between the first and second signals is sufficiently pronounced, the ejector 50 segregates the corresponding portion (plain cigarette) of the rod 6 from the other (satisfactory) portions at a suitable location in the cigarette maker. Reference may be had to cigarette makers of the type known as GARANT (trademark) or SE 80 (both produced and sold by the assignee of the present application) which embody suitable ejector means for defective cigarettes. The ejector means 50 normally comprises a nozzle which discharges a jet of compressed gaseous fluid in response to reception of a third signal of appropriate intensity to effect the ejection of the adjacent cigarette from a flute at the periphery of a rotating drum or an analogous conveyor serving to transport randomly distributed satisfactory and defective cigarettes to storage, to a filter tipping machine, to a packing machine or to another destination.

Alternatively, or in addition to direct connection between the comparator 17 and the ejector 50, the signals which appear at the output C of the comparator 17 can be displayed at 51 so that the attendant or attendants can ascertain the density of the rod 6 and can undertake the necessary steps if the density deviates from a desired value or from a range of acceptable values. The displaying means 51 may constitute a voltmeter or an analogous instrument. Still further, or in addition to displaying the signals which appear at the output C of the comparator 17, it is possible to utilize such signals (as at 52) for direct adjustment of the machine which produces the rod, for example, to adjust a distributor serving to deliver tobacco shreds which are converted into the filler of the rod 6.

The switching device 28 energizes the electromagnet 27 at regular intervals, e.g., every 100 seconds, to shift the diaphragm 7 from the illustrated first position to the second position in which the diaphragm 7 intercepts the sample beam 4 but permits the reference beam 9 to pass through the aperture 8', to bypass the path for the rod 6, and to impinge upon the ionization chamber 3. At the same time, the operative connection 20 between the electromagnet 27 and the switchover device 21 causes the movable contact 21*a* to assume the broken-line position of FIG. 1 so that the output 3A of the ionization chamber 3 is disconnected from the branch 16 of the evaluating circuit 14 but the (second) electric signal which appears at the output 3C is transmitted to the signal storing circuit 18 via averaging circuit 19. The switching device 28 causes the conductor 29 to transmit a signal which erases the previously stored second signal and enables the circuit 18 to accept the fresh second signal from the output of the averaging circuit 19.

While the second or reference signal is being transmitted to the signal storing circuit 18 via amplifier 13, switchover device 21 and averaging circuit 19, the transmission of first signals to the input A of the comparator 17 is interrupted because the diaphragm 7 maintains the aperture 8 out of register with the component 2 of the radiation source 1, i.e., the diaphragm 7 intercepts the sample beam for the relatively short interval of time during which the amplifier 3 generates a fresh reference signal which is immediately transmitted to the signal storing circuit 18. As mentioned above, the circuit 18 is then ready for reception of the fresh reference signal because its input a has received a signal from the switching device 28 via conductor means 29, i.e., the previously stored reference signal is erased and the freshly generated and transmitted second signal is stored for the forthcoming interval of transmission of first signals from the output 3A via moving contact 21*a* of the switchover device 21 and on to the output A of the comparator 17. Thus, substitution of a fresh reference signal for the previously stored reference signal takes place in automatic response to shifting of the diaphragm 7 from the first to the second position, i.e., in response to temporary interruption of measurement of density of the rod 6.

The diaphragm 7 can be replaced with a device having a single aperture which registers with the component 2 in the first position and with the component 2' in the second position of such device. The apparatus of FIG. 1 exhibits the advantage that it can utilize a stationary source of penetrative radiation and that the mass of the device (diaphragm 7) which is movable between the first and second positions is very small.

Figure 2:
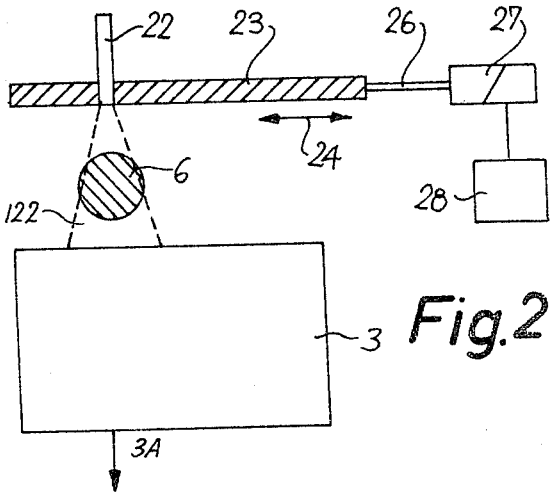
FIG. 2 is a similar diagrammatic partly sectional view of a portion of a modified apparatus wherein the radiation source consists of a single radiation emitting component.

FIG. 2 illustrates a portion of a second density measuring apparatus wherein the selector unit comprises a modified reciprocable device, namely, a slide or carriage 23 which supports a modified source of penetrative radiation, namely, a single radiation emitting component 22 which shares the movements of the slide 23 between the first position (shown in FIG. 2) and the second position (not shown) in which latter position the radiation emitting component directs a beam 122 of radiation directly against the ionization chamber 3, i.e., the beam 122 then bypasses the rod 6 which moves lengthwise along a path exteding at right angles to the plane of FIG. 2. In the illustrated first position of the slide 23, the beam 122 is a sample beam because it penetrates through successive increments of the rod 6 and, therefore, the output 3A of the ionization chamber 3 transmits first electric signals which are indicative of the density of the respective increments of the rod. The path for the rod 6 is located between the ionization chamber 3 and the path along which the slide 23 is reciprocated by a connection 26. The connection 26 may constitute the reciprocable armature of an electromagnet 27 which constitutes the drive means for the slide 23. The manner in which the electromagnet 27 receives energizing and deenergizing impulses from the time-dependent switching device 28 is preferably the same as described in connection with FIG. 1. Furthermore, the evaluating circuit which processes signals furnished by the output 3A of the ionization chamber 3 is preferably identical with or analogous to the evaluating circuit 14 of FIG. 1. Thus, the evaluating circuit which alternately receives first and reference signals from the output 3A of the ionization chamber 3 of FIG. 2 also comprises a storing circuit for second signals, an averaging circuit between the switchover device (corresponding to the device 21 in FIG. 1) and the signal storing circuit, a comparator which receives first signals by way of an amplifier and the aforementioned switchover device (in the illustrated first position of the slide 23) and which also receives a second signal from the signal storing circuit during each interval of transmission of a series of first signals. The duration of such intervals (as well as of intervals during which the slide 23 intercepts the beam 122) is selected by the time-dependent switching device 28. The double-headed arrow 24 indicates the directions of reciprocatory movement of the slide 23 between its first and second positions.

The time-dependent switching device 28 of FIG. 1 or FIG. 2 may constitute a timer clock, a programming unit, an electronic counter or any other device which can energize and deenegize the electromagnet 27 for given first and second intervals of time. Such intervals are preferably variable.

The mode of operation of the density measuring apparatus which embodies the structure of FIG. 2 is analogous to that of the apparatus which is shown in FIG. 1. Thus, when the slide 23 dwells in the illustrated first position, the (sample) beam 122 penetrates through the rod 6 before it reaches the ionization chamber 3 which generates first electric signals. Such signals are amplified and transmitted to the input A of the comparator 17 (not shown in FIG. 2) via movable contact 21*a* of the switchover device 21 (also not shown in FIG. 2). At the same time, the input B of the comparator receives that second or reference signal which is stored in the circuit 18 (not shown in FIG. 2). The frequency at which the previously stored reference signals are replaced with fresh reference signals depends on the setting of the switching device 28, and such repeated replacement of reference signals compensates for eventual drift of the operating point of the ionization chamber 3. The gaging of the rod 6 with the (sample) beam 122 is interrupted when the previously stored reference signal is replaced with a fresh reference signal because the (reference) beam 122 then bypasses the path for the rod 6. The intervals of interruption of density measurements are very short, i.e., just sufficient to ensure that the signal storing circuit 16 receives a fresh reference signal. Such intervals can constitute a minute fraction of a first interval, namely, of that interval during which the beam 122 passes through the rod 6 prior to reaching the ionization chamber 3. It has been found that replacement of the reference signal at 100-second intervals is quite satisfactory; this reliably prevents eventual drifting of the operating point of the ionization chamber 3 from influencing the results of measurement of density of the tobacco-containing rod 6. However, the first intervals can be made much longer or much shorter than 100 seconds, depending on the design of the ionization chamber, on the desired degree of reliability of density measurements and/or on certain other factors.

The improved apparatus is susceptible of many additional modifications without departing from the spirit of the invention. For example, the ionization chamber 3 can be replaced with a different transducer, e.g., a suitable photoelectronic multiplier.

The reference signal which is generated when the ionization chamber 3 is exposed to radiation from the device 2' (FIG. 1) or from the device 22 (while the beam 122 bypasses the rod 6) is used for intermittent calibration of the evaluating circuit. Since the first and second signals are generated by one and the same transducer, any drifting of the operating point of the ionization chamber cannot result in distortion of density signals because the distortion of first signals is invariably proportional to distortion of the reference signals.

An important advantage of the improved apparatus is that the calibrating operation can be carried out while the machine in which the apparatus is installed need not interrupt the manufacture and/or processing of the rod 6. Since the duration of second intervals is or can be only a small fraction of the duration of first intervals, the absence of regulation (if any) of the density adjusting means 52 in a cigarette maker or the like for relatively short (second) intervals does not affect the quality of the rod. As a rule, the signal at the output C of the comparator 17 will be used for direct regulation of the density adjusting means 52.

The apparatus which includes the structure of FIG. 2 exhibits the important advantage that it can operate with a single source (22) of penetrative radiation. This is particularly important if the component 22 is a source of radioactive rays.

The radiation source may include a source of strontium 90, a strong beta ray generator or the like.

A further important advantage of the improved apparatus is that the drifting (if any) of the operating point of the transducer is fully compensated for because the operation of the transducer is monitored at relatively short intervals regardless of whether or not the machine in which the apparatus is installed is in actual use. Moreover, the number of parts which constitute the improved apparatus is surprisingly small, and the third signals which are transmitted by the output C of the comparator 17 are invariably devoid of any influence of eventual drifting of operating point of the ionization chamber.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for measuring the density of a moving rod which contains tobacco or other fibrous material and is transported along a predetermined path, comprising a source of penetrative nuclear radiation, said source including a first component which emits radiation in a direction toward transducer means by way of the rod in said path and a second component which emits radiation toward said transducer means while bypassing the rod in said path; selector means operative to alternately cause the radiation issuing from said source to propagate itself (a) across said path whereby the intensity of radiation decreases during penetration through the rod in said path proportionally with the density of the corresponding portion of the rod, and (b) past said path so that the intensity of radiation which bypasses the rod in said path remains substantially unchanged; common transducer means for converting the radiation which has penetrated through the rod in said path into first electric signals and for converting the radiation which has bypassed said path into a series of successive second electric signals; and signal evaluating means connected with said transducer means and including means for storing successive second signals during penetration of radiation through the rod in said path within the interval of time that follows the generation of the stored second signal and ends on generation of the next second signal which forms part of said series and replaces the stored second signal, and means for comparing each stored second signal with those first signals which are generated by said transducer means during storage of a second signal.

2. The apparatus of claim 1, wherein said transducer means comprises an ionization chamber.

3. The apparatus of claim 1, wherein said selector means comprises a device movable between a first position in which said device prevents radiation from bypassing said path and a second position in which said device prevents radiation from penetrating through the rod in said path, and means for alternatively maintaining said device in said first and second positions for first and second intervals of time.

4. The apparatus of claim 3, wherein said second intervals are shorter than said first intervals.

5. The apparatus of claim 3, wherein the duration of said first intervals is approximately 100 seconds.

6. The apparatus of claim 3, wherein said means for maintaining includes a drive for moving said device and time-dependent switching means for said drive.

7. The apparatus of claim 3, wherein said device includes a slide which is reciprocable between said first and second positions, said source including a single radiation emitting component which shares the movements of said slide.

8. The apparatus of claim 7, wherein said path is disposed between said slide and said transducer means.

9. The apparatus of claim 8, wherein said means for maintaining includes means for automatically moving said slide to said first position after elapse of a second interval and for automatically moving said slide to said second position after elapse of a first interval.

10. The apparatus of claim 3, wherein said device includes a diaphragm which intercepts radiation issuing from said second component in the first position and which intercepts radiation issuing from said first component in the second position of said device.

11. The apparatus of claim 10, wherein said diaphragm has a first aperture which transmits radiation issuing from said first component in said first position and a second aperture which transmits radiation issuing from said second component in said second position of said device.

12. The apparatus of claim 10, wherein said source is stationary.

13. The apparatus of claim 3, wherein said means for maintaining includes electromagnet means having a movable portion connected with said device and time-dependent switching means for energizing and deenergizing said electromagnet means.

* * * * *